US011657746B2

(12) United States Patent
Touvet

(10) Patent No.: US 11,657,746 B2
(45) Date of Patent: May 23, 2023

(54) METHOD FOR PRODUCING A BISTABLE DISPLAY DEVICE WITH LOW-VOLTAGE MICROCONTROLLER

(71) Applicant: THALES DIS FRANCE SAS, Meudon (FR)

(72) Inventor: Stephane Touvet, Gemenos (FR)

(73) Assignee: THALES DIS FRANCE SAS, Meudon (FR)

( * ) Notice: Subject to any disclaimer, the term of this patent is extended or adjusted under 35 U.S.C. 154(b) by 0 days.

(21) Appl. No.: 17/482,593

(22) Filed: Sep. 23, 2021

(65) Prior Publication Data

US 2022/0028315 A1 Jan. 27, 2022

Related U.S. Application Data

(63) Continuation of application No. 16/343,647, filed as application No. PCT/EP2017/076853 on Oct. 20, 2017, now Pat. No. 11,158,223.

(30) Foreign Application Priority Data

Oct. 20, 2016 (EP) ..... 16306375

(51) Int. Cl.
*G09G 3/16* (2006.01)

(52) U.S. Cl.
CPC ..... *G09G 3/16* (2013.01); *G09G 2310/0254* (2013.01); *G09G 2310/068* (2013.01)

(58) Field of Classification Search
None
See application file for complete search history.

(56) References Cited

U.S. PATENT DOCUMENTS

| | | | | |
|---|---|---|---|---|
| 9,424,797 | B1 | 8/2016 | Sandock et al. | |
| 2008/0238900 | A1 | 10/2008 | Saito | |
| 2008/0273007 | A1 | 11/2008 | Ng et al. | |
| 2008/0303780 | A1* | 12/2008 | Sprague | G09G 3/344 345/107 |
| 2010/0238093 | A1 | 9/2010 | Lu et al. | |
| 2010/0328286 | A1 | 12/2010 | Piasecki et al. | |
| 2011/0063340 | A1 | 3/2011 | Umezaki et al. | |
| 2014/0253425 | A1* | 9/2014 | Zalesky | G09G 3/344 345/107 |
| 2016/0247458 | A1* | 8/2016 | Muto | G06F 1/3265 |
| 2016/0260409 | A1* | 9/2016 | Lin | G09G 3/20 |

* cited by examiner

*Primary Examiner* — Andre L Matthews
(74) *Attorney, Agent, or Firm* — Marc Boillot; Thales DIS CPL USA, Inc

(57) ABSTRACT

The invention more particularly relates to a method and device for controlling a segmented electrophoretic display. Such displays, preferably covered by the invention, comprise a layer (or a film) of microcapsules containing colored particles suspended in a fluid or a gas, the same layer being sandwiched between two electrodes:

at least one first electrode having the shape of the segment to be displayed a second transparent electrode made by a conductive layer of indium tin oxide (ITO) for example. Alternative electrodes based on a thin film of carbon nanostructures, silver or copper wires can also be used.

11 Claims, 5 Drawing Sheets

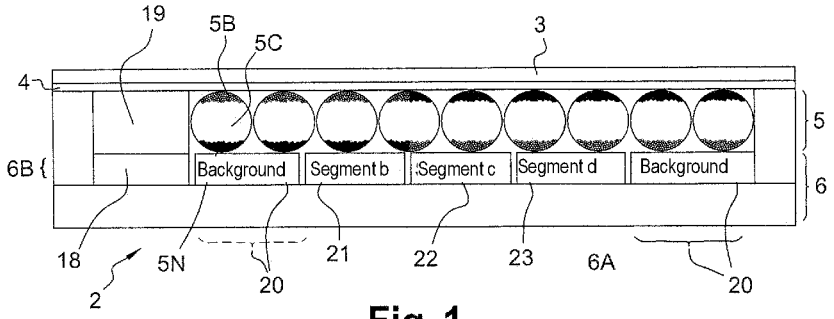
Fig. 1
Fig. 2
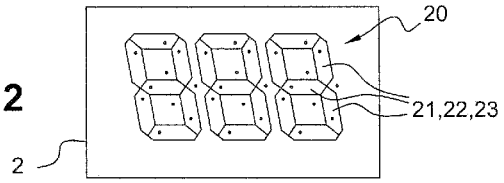
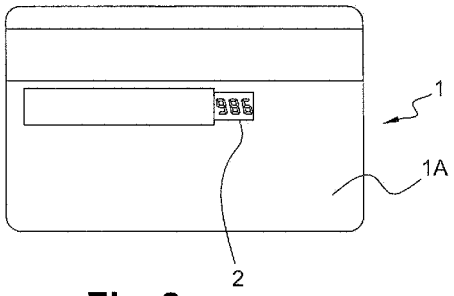
Fig. 3

METHOD FOR PRODUCING A BISTABLE DISPLAY DEVICE WITH LOW-VOLTAGE MICROCONTROLLER

CROSS-REFERENCE TO RELATED APPLICATIONS

This application is a continuation of U.S. patent application Ser. No. 16/343,647, filed Apr. 19, 2019, and claiming priority thereto, which is a U.S. National Stage of a 371 International Application No. PCT/EP2017/076853, filed Oct. 20, 2017, 2017, and claiming priority thereto, which claims the benefit of a European (EP) foreign application No. 16306375.3, filed Oct. 20, 2016, and claiming priority thereto, each of which is incorporated by reference herein in its entirety.

Method for producing a bistable display device with low voltage microcontroller.

TECHNICAL FIELD OF THE INVENTION

The invention relates to a method for producing (or manufacturing) a display device for electrophoretic or bistable displays.

The invention more particularly relates to a method and device for controlling a segmented electrophoretic display.

Such displays, preferably covered by the invention, comprise a layer (or a film) of microcapsules containing colored particles suspended in a fluid or a gas, the same layer being sandwiched between two electrodes:

- at least one first electrode having the shape of the segment to be displayed
- a second transparent electrode made by a conductive layer of indium tin oxide (ITO) for example. Alternative electrodes based on a thin film of carbon nanostructures, silver or copper wires can also be used.

The invention also relates to electronic products or devices that use the above-mentioned type of display. The display can be used, for example, in smart cards, especially bank cards or other types of cards with a thin display area and requiring a certain flexibility, flash drives, watches . . . .

PRIOR ART

In bank cards, we are currently witnessing the appearance of a system integrated into the card allowing the display of a dynamic cryptogram (dCVV). This code may vary over time and is displayed with small displays on the back of a credit card. Displays also make it possible to display single-use codes such as OTP (one time password) to carry out secure on-line transactions.

There are microcontrollers with specific display controls for electrophoretic displays or equivalent. For example, we know that the EPSON S1C17F57 microcontroller can perform this function.

TECHNICAL PROBLEM

Some display smart cards, such as dynamic cryptogram (DCVV) cards, require bistable electrophoretic display due to the need for permanent display and energy consumption constraints.

Electrophoretic displays require a specific control or microcontroller because the voltage required in absolute value for their control cannot generally be provided by current (or standard) microcontrollers, especially if the latter is powered by a battery that only supplies a voltage, in particular 3V, that is significantly lower than the operating voltage in absolute value of the display.

Specific microcontrollers for segmented electrophoretic displays are still not widely available and in fact remain more expensive.

The purpose of the invention is to propose a more economical method for producing electrophoretic display control devices that can replace specific control microcontrollers.

Alternatives to the invention proposed below by the inventor have the following disadvantages:

- A possible alternative would be to supply the microcontroller with 2 lithium batteries in series to raise the voltage to 6V. The disadvantage of this solution is that it increases the cost of the battery and the space it occupies;
- Another alternative would be to increase the lithium battery voltage from 3V to 5V for powering the microcontroller, but due to the thickness constraints of the board, a DC-DC converter solution, if possible without inductance, should be used. Such a solution would use a capacity-based charge pump, but the resulting efficiency and current increase would result in poor power consumption performance and reduce battery life;
- The use of a standard microcontroller combined with an external display controller would lead to two circuits and therefore be more expensive;
- Finally, the electrophoretic screen controller function could be added with a microcontroller and programme memory (Flash, ROM) in an ASIC, but developing such a circuit is relatively expensive.

The current market offer for a microcontroller integrating a control for segmented electrophoretic displays is not very widespread, which makes it difficult to diversify supply sources.

SUMMARY OF THE INVENTION

The invention proposes a simple and inexpensive method for manufacturing/producing a device with a segmented electrophoretic display.

The invention also proposes a method/programme for controlling a segmented electrophoretic display.

In the principle of a preferred mode, the invention provides for standard components (not specific to the above-mentioned bistable displays). It includes a current or standard microcontroller (with a maximum output voltage lower than the minimum operating voltages, in absolute value, of the display, a programmable, preferably flash memory and integrated into the microcontroller, some external components and a specific control programme (described later)). This type of microcontroller chosen preferentially by the invention is distinct from a specific display controller for bistable displays, in particular segmented electrophoretic displays.

The microcontroller is also preferably supplied with a so-called low voltage, which is lower in absolute value than those required to control the display. In its preferred application, the microcontroller is powered by a voltage of 3V (V=volts) or close to 3V and includes input/output ports (GPIOs) with an output voltage excursion from 0 to 3 volts. The display concerned has a minimum operating voltage of 5 volts in absolute value.

A remarkable feature of the preferred mode of the invention is the specific design of a generator, here in the form of a charge pump, to provide +5V and −2V on a common electrode of the display. This generator can be controlled directly by the microcontroller with only two input/output ports with a voltage excursion between 0 and 3V.

To this end, the purpose of the invention is a method for producing a segmented electrophoretic display device (25) comprising a bistable display operating at predetermined opposing voltages (+dV; −dV) and an electronic circuit with microcontroller for controlling the display according to a control programme (P), characterized in that it comprises the following steps:

- supplying the microcontroller, which is different from a specific display controller for a bistable display and configured to deliver voltages (Vsegment) on input/output ports, lower in absolute value than the predetermined voltages (+dV; −dV),
- compensating the voltages (Vsegment) with at least one compensation voltage (Vcom) to at least reach said predetermined opposing voltages (+dV; dV).

The device thus configured makes it possible carry out a control of a bistable display at a lower cost, with a low-cost (standard) microcontroller, the output voltages being supplemented by additional voltages (or potentials) generated in particular by means of a circuit of discrete components such as capacities, diodes and transistors.

According to other features:

- The compensation is performed using a voltage generator;
- The control programme includes instructions configured to control said voltage generator in such a way as to provide said compensation;
- The voltage generator is configured to provide voltage values equal to (+5; −2) volts.
- The microcontroller is configured to provide a first pair of voltages (+3; 0) volts.
- The microcontroller comprises input/output ports which can be individually controlled with a "0", "1" status and high impedance (HIZ) and including a programme memory.
- The programme provides values equal to (−5V, +5V) to control a color switching of the segments or the background of the display and voltage values equal to (−2V, +2V) for maintaining the colors of the segments (or the background);
- The programme P may provide for the string of successive sequences (or steps):
- homogenization in a uniform color of all the segments including the black or white background with a duration of 5 time units;
- inversion of the uniform color of all the segments including the white background if previously black or black if previously white with a duration of 7 time units;
- if needed, updating the segments in white if previously black or black if previously white with a duration of 5 time units.

The invention also relates to the device corresponding to the above method; The segmented electrophoretic display device includes a bistable display operating at predetermined opposing voltages (+dV; −dV) and an electronic circuit with microcontroller for controlling the display according to a control programme; The device is characterized in that it comprises:

- said microcontroller, which is different from a specific display controller for bistable displays and being configured to deliver voltages (Vsegment) on input/output ports, lower in absolute value than the predetermined voltages (+dV; −dV),
- a compensation voltage generator (Vcom) configured to compensate said voltages (Vsegment) and reach at least said predetermined opposing voltages (+dv; −dV).

Thus, the invention makes it possible to simply use a common low-voltage microcontroller that is not intended to control a segmented electrophoretic bistable display, complemented by a generator and some discrete electrical/electronic components).

Preferably, the voltage generator includes a charge pump;

- The microcontroller preferably comprises a control programme P configured to provide voltages at times and for durations according to a balanced control scheme so that the average value of the voltage seen from each of the segments tends towards 0;
- The voltage generator preferably comprises a hybrid charge pump combining a voltage doubling circuit and a voltage inverter circuit, the respective output voltages of the doubling circuit and the inverter circuit being alternately combined on a single output of the charge pump; this hybrid charge pump generator has the advantage of combining the two voltage doubling and voltage inverter functions so that the signal from one or the other function is generated on a single output. This output corresponds here to the common electrode of the display;
- The microcontroller comprises a control programme P to provide the voltages at times and for durations according to a balanced control scheme so that the average value of the voltage seen from each segment is close to 0 volt.

BRIEF DESCRIPTION OF THE FIGURES

FIG. 1 shows a schematic cross-section of a bistable display with ink capsules among those usable by the invention;

FIG. 2 shows a top view of the display with three numeric character areas formed by segments such as used in a preferred embodiment of the invention;

FIG. 3 shows a display object with a display device, in accordance with those covered by the invention and in the form of a smart card;

DESCRIPTION

Figure 4:
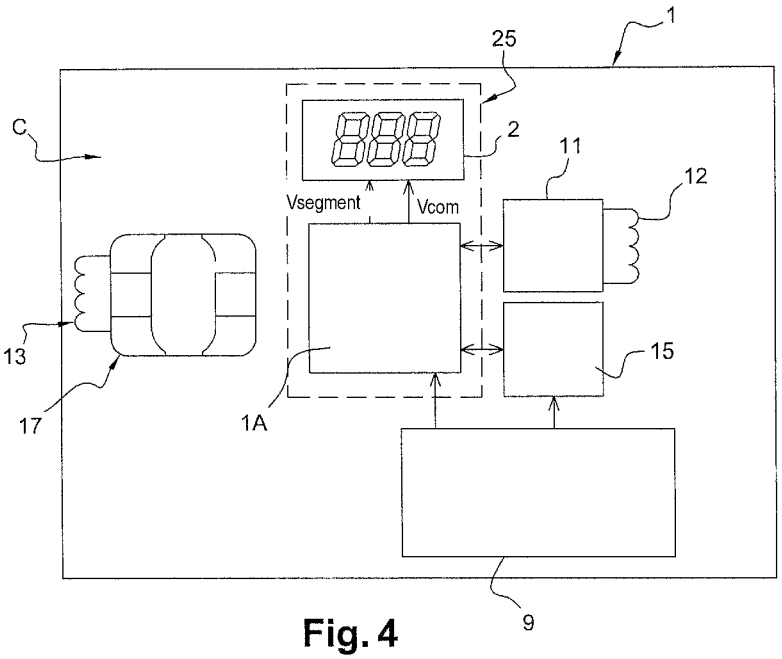
FIG. 4 illustrates a possible electrical and/or electronic circuit diagram of the display object of the preceding figure.

In FIG. 1, a bistable electrophoretic display 2 (or display complex) (also called "ePaper" or electronic paper) for the display device 1 (FIGS. 3 and 4) in a preferred mode of the invention comprises a film 5 of microcapsules containing specifically white 5B and black 5N ink, in suspension in a fluid 5C and sandwiched between an ITO layer 4 or a transparent electrode and other electrodes consisting of a printed circuit board 6 carried by a here flexible substrate 6A.

The ITO layer is attached to (or supported by) a transparent polymer substrate 3. The printed circuit board facing the microcapsules contains as much of a segment as an electrode and the shape of each electrode defines the shape of each respective segment. Finally, a connection is added between each segment and the display connector. The assembly including the transparent polymer 3 the ITO layer 4, the microcapsules 5C layer 5 and a layer or printed circuit 6, forms the display 2 complex.

The display particles 5B, 5N here are electrically charged and move in the microcapsules 5 according to the voltage that is applied on the one hand on the transparent conductive layer 4, and on the other hand on each of the segments of the conductive layer 6B of the flexible printed circuit 6.

Returning to FIG. 1, the display 2 includes a common electrode 18 arranged on the printed circuit 6 and electrically connected to the transparent conductive electrode 4 via an adhesive or a conductor 19 in particular of an anisotropic type or not.

The printed circuit board 6 includes conductive control (or command) areas 20 and 21, 22, 23 corresponding respectively to a background area 20 of the display and segment areas 21, 22, 23; The segment areas display the information for a segment color contrasting with the color of the background area.

The printed circuit board 6 may preferably contain a circuit for controlling the display layer or contain at least control conductive tracks or areas 6B intended to have an electrical polarity to influence the display layer 5.

Depending on the voltage difference (dV in volts) applied to the common electrode and the segment conductive areas, the polarized particles of the capsules will be concentrated in the upper and lower parts of the capsules according to their respective polarity. All the segments have a common electrode 18 (connected to the transparent conductive layer 4).

Conventionally in the description, the term "volt" can also be referred to as (V) and the numerical/digital values such as "0", "1" when they are in quotation marks. The numerical/digital values "0", "1" respectively correspond to the voltage values 0 volt (or 0V) and +3 volt (or +3V).

In FIGS. 2, 3 and 4, the display 2 of the electrophoretic type is shown in a top view. It is integrated, in the example (FIG. 3), in an electronic object (or device) 1 with an intelligent display device or circuit 2 (with a microprocessor). The object 1 is in the form of a smart card, particularly a bank card.

Figure 5:
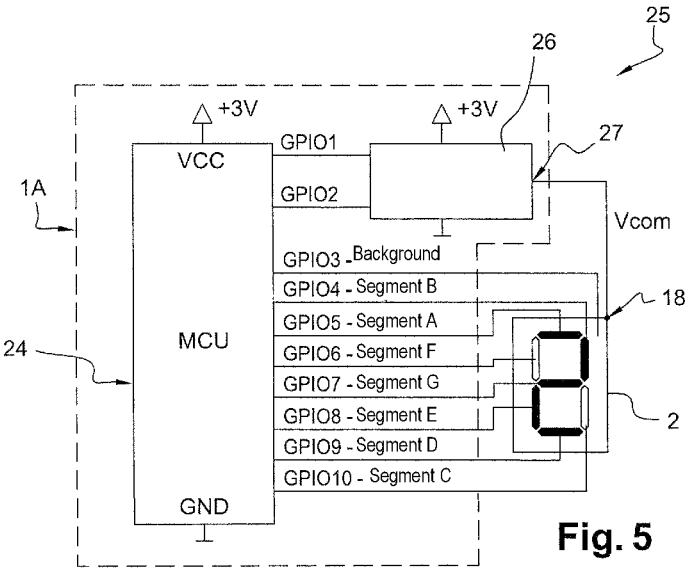
FIG. 5 illustrates an electronic circuit for controlling a numeric character area of the display in accordance with the preferred mode of implementation or embodiment of the invention.

The display 2 is connected to a display electronic circuit 1A integrated in the card body 1 (not visible in FIG. 3). The assembly including the electronic circuit of the display 1A and the display 2, forms, includes or constitutes a display device 25 (FIGS. 4 and 5).

Alternatively, the display device 25 (or the display circuit 1A) of the invention may be used for electronic products or devices requiring a bistable display that makes it possible to visualize the indicator by means of graphic or alphanumeric character symbols such as a watch, a toy, a status indicator . . . and being supplied by a voltage lower than 5V. The display device 25 (or display circuit 1A) may be an electrical and/or electronic sub-assembly (insert or "inlay") intended to manufacture one of the above-mentioned devices including at least one area of display or the display 2.

Similarly, the same applies to the display device 25 (or display circuit 1A) can be a module or an insert, (intermediate product) ready for use or intended to be inserted or inserted/connected in another body or support. It can include at least the display area, one or more connection or interconnection components and a printed circuit with integrated circuit components, in particular for controlling the display layer.

FIG. 4 shows an electrical/electronic circuit C of the smart card 1 in FIG. 3; The circuit C includes the display 2 connected to the electronic circuit 1A including a microcontroller 24 for controlling (or driving) the display of information on the screen 2.

The circuit C may include a radio frequency interface with an NFC radio frequency controller 11 and an antenna 12, connected to the microcontroller 10, a real time clock 15 RTC, one battery 9, if necessary a switch button. The card 1 may include a combined smart card module 17 with electrical contacts and/or without contact with a radiofrequency antenna 13.

FIG. 5 illustrates the display device 25, produced according to a production (or manufacturing) method corresponding to a first preferred embodiment and which may be suitable to constitute/replace the microcontroller circuit 1A of the preceding figure. This device includes a bistable display 2, of one of the (segmented electrophoretic 1A) types mentioned above; the bistable display 2 operates or is controlled at supply (and/or command or control) predetermined minimum opposing voltages, both positive and negative (+dV; −dV); the device 25 comprises an electronic display circuit 1A with a microcontroller 24 for controlling the display according to a control programme P included here in a programme memory of the microcontroller;

In the example, the display is a 3-digit segmented electrophoretic display (elnk corporation ref: SC004221) although only one digit is shown, the principle can be applied to several digits). The operating and/or control (or command) voltage is between 5 and 15 volts and −5 and −15 volts;

In other words, to switch from one color of a segment or each capsule to another, it is necessary to apply a voltage difference, between the common electrode 4 (or 18) and the control or command electrode of the background or of a segment 20-23 of at least +5 volts (+dV) to change the color and at least −5 volts (−dV) to return to the original color;

In accordance with this preferred mode, the method includes the following steps:

(a) supplying a microcontroller 24 configured to deliver voltages (which may depend on the source of the power supply 9), lower in absolute value than the predetermined voltages +dV; −dV, b) compensating the voltages delivered by the microcontroller to at least reach said predetermined opposing voltages +dV; −dV required for operation.

The microcontroller 24 selected for the invention in step a) is configured to deliver a first control voltage of the display below the minimum voltage of 5 volts mentioned above;

In the example, the (standard) microcontroller 24 operates at a supply voltage equal to (or in the order of) 3 volts and is capable of delivering a voltage on input/output ports the voltage excursion of which is (or in the order of) 0 to 3 volts. It is designed to be powered by a 3 volt battery 9.

In general, a voltage equal to a value for the purposes of this application can be considered when it is close to 10% of that value, or even preferably 5%. Thus a voltage between 2.7 volts and 3.3 volts is considered to be equal to 3 volts.

The microcontroller also includes a plurality of output interfaces;

Here in the example shown, it includes input/output ports GPIO for general purposes from 1 to 10 GPIO1-GPIO10. The output ports GPIO4 to GPIO10 are each connected to their respective segment marked from a to f (and corresponding to the conductive areas 21-23 of the printed circuit 6, for control purposes). Similarly, the output port GPIO3 is connected to the conductive area 20 corresponding to the background of the display screen 2.

With this microcontroller 24 selected for the invention, the GPIO ports can only deliver a maximum voltage of +3 volts to the different segments of the display, which is insufficient to activate the capsules 5C and the color changes of the different display areas (the background and the segments 20-23).

At most, this microcontroller 24 could provide a voltage of 0 volt to the common electrode and +3 volt to a segment (or background) i.e. a voltage dV=+3V and conversely a voltage of +3 volt to the common electrode and 0 volt to a segment (or the background) or a voltage dV=−3 volt. Therefore, a voltage of 2 volts in absolute value is needed to enable the display to operate. The invention makes it possible to provide this needed voltage (or potential) with at least one compensation voltage (or potential of at least 2 volts).

A (standard) MCU microcontroller 24 that may be suitable for the invention preferably includes the following functions.

- The normal functions of a CPU microprocessor (the number of bits does not matter);
- GPIO input/output ports; Preferably these inputs/outputs are individually configurable:
  - input or high impedance (HIZ),
  - at the output ("push-pull" or totem pole) ("1" or "0")

Preferably, the microcontroller should allow each GPIO port to be configured individually in HIZ, in digital value "1" or "0" (equivalent to 3 volts and 0 volt respectively).

- The microcontroller should preferably have at least as many GPIO ports as necessary segments, plus four additional GPIO ports (respectively for wallpaper area 20, transparent common electrode area 18 and two ports for the charge pump control). For example, for a 3-digit dCW display (Dynamic Gard Verification Value): it is necessary to have (7×3)+2+2=25 GPIO ports;
- A programme memory (but it can be external);
- Possibly, the microcontroller can have timers for an easier management of the indicated times T1, T2, T3 but are not essential, since they can be substituted in particular by means of a simple waiting loop, for example.

Today, most microcontrollers (CPUs) support all the above functions.

To make the display functional, the invention provides for step b) above of compensating the voltages from the microcontroller to at least reach said predetermined opposing voltages +dV; −dV required for operation.

Figure 6:
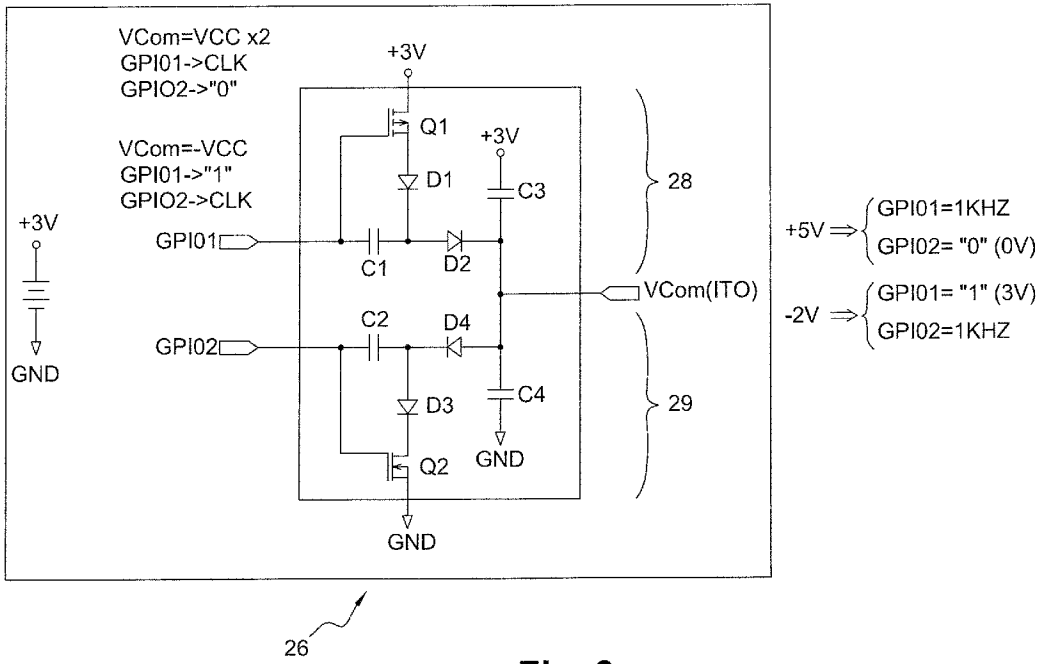
FIG. 6 illustrates an example of the design of the voltage generator 26 of the circuit in the preceding figure, said generator being here in the form of a hybrid charge pump.

In the example, the invention therefore provides and adds a second voltage to the first voltage of +3 volts to provide at least the minimum required voltage (in this case +5 volts). This is preferably achieved with the generator circuit 26 described below (FIG. 6).

According to a preferred method of implementation or embodiment, the invention provides a particular voltage source allowing compensation of voltages/potentials (or compensation of voltage deviation) obtained according to the table below.

In the example, the source is therefore a voltage generator 26. This generator is preferably controlled by the microcontroller 24; for this purpose, the latter includes output ports GPIO 1 and GPIO2 connected to this voltage generator 26.

This generator 26 is powered like the microcontroller by a battery 9 which is preferably the same as the microcontroller (+3V). The voltage generator also has an output 27 (Vcom) which is connected to the transparent common electrode 18.

Thus, thanks to a suitable programme P, provided to the standard microcontroller 24, preferably in an EEPROM or internal flash memory (or not) to the microcontroller, the invention proposes to control the display 2. This control occurs as if the display device 25 had a dedicated microcontroller capable of delivering a sufficient control output voltage of at least 5 volts. Preferably, according to this programme P (or convention), the invention provides that a single, positive or negative voltage (e.g. +5 and −5 volts), causes a change in color in the display.

According to the preferred mode, the microcontroller 24 applies the positive voltage values +0 or +3 volts (which it is able to deliver normally) to the segments (or the background) according to a segment (or background) voltage management programme P. The charge pump 26 delivers at the output 27 and applies the voltage values Vcom=+5 volts or −2 volts to the common electrode 18 also according to the programme P for voltage management/electrode potential 18.

A first control potential difference of −5 volts "dV=0−5" is obtained by setting the lowest potential value of the microcontroller (0 volt) on the segments or the background; this last voltage is compensated (or completed) by a voltage (or potential) of +5 volts set on the electrode 18 and obtained by a charge pump 26.

A second difference of +5 volts in control potentials is also obtained "dV=3−2» by setting the highest potential value of the microcontroller +3 volts always on the segments (or the background), this last potential value being compensated (or completed) by a voltage (or potential) Vcom of −2 volts set on the electrode 18, obtained by the charge pump.

Thanks to this preferred compensation scheme, it is possible to control the display with the voltages required for the operation of the display.

In the example, this generator 26 includes (or consists of) a charge pump (detailed later in reference to FIG. 6).

Figure 7:
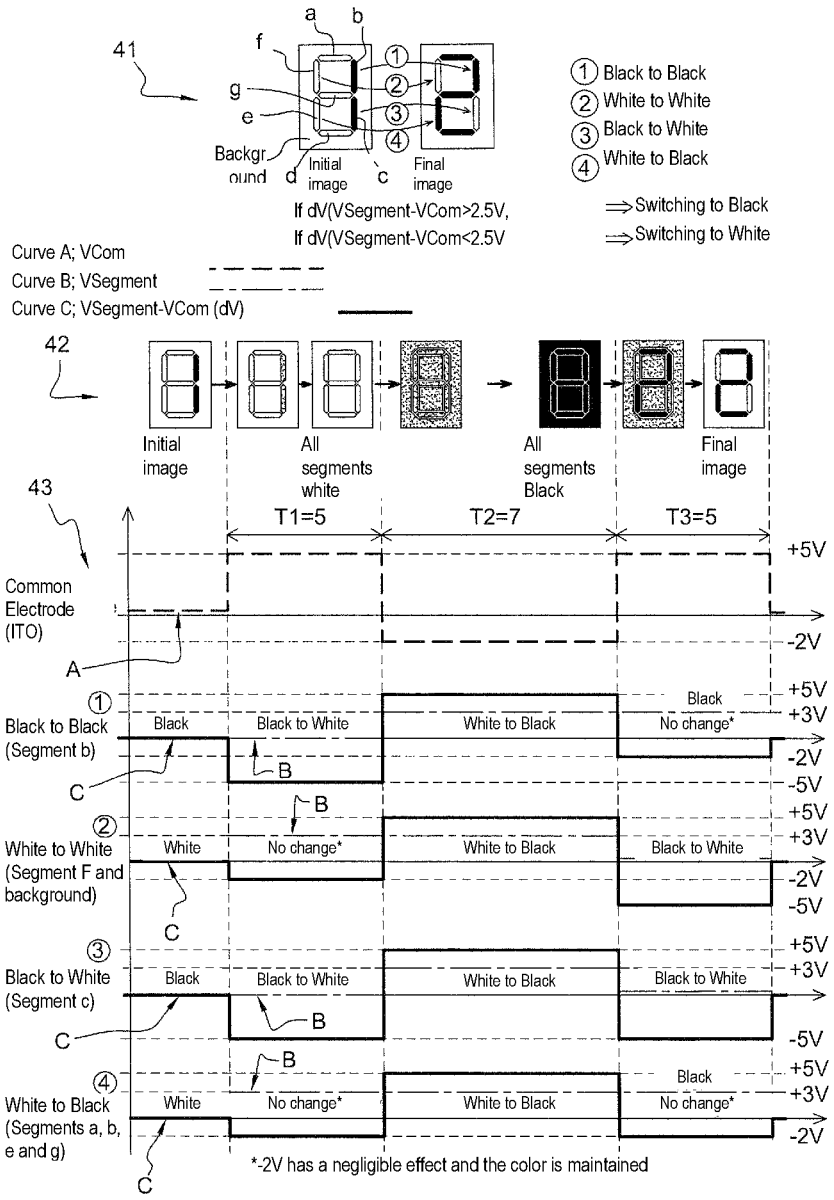
FIG. 7 illustrates recommended (or preferred) intermediate steps and/or transitions of color and/or images of the display device, in accordance with the preferred mode of the invention.

The operation of the display control is described in relation to the steps in the diagram in FIG. 7, which may correspond to the steps of a programme P (or cable logic circuit) provided in the microcontroller to control a segment or background area 20.

Taking into account the limitation of the output voltage excursion here in the example from 0 to 3V for output ports (GPIO1 to GPIO10), this preferred mode of the invention provides for possible voltages to update the display, reported in the table below:

| Voltage Vcom on common electrode (volts) | Voltage Vsegment on segments (or background) GPIO3 to GPIO10 (volts) | Voltage difference dV (Vsegment-Vcom) on capsules 5 C (volts) |
|---|---|---|
| +5 | +3 | 3-5 = −2 |
| +5 | 0 | 0-5 = −5 |
| −2 | +3 | 3 − (−2) = +5 |
| −2 | 0 | 0 − (−2) = +2 |

Another remarkable feature of this preferred mode of the invention is the low sensitivity of the display when the absolute value of the voltage difference dV, between the segments (or the background) and the transparent common electrode (or 18), is less than 2.5 volts.

It can be considered that this low voltage has no significant effect on the (white or black) current status of the segment.

Thus, the low sensitivity is advantageously used by this preferred mode of the invention for a particular control scheme or principle below:

High voltage deviations dV (−5V, +5V) can be used to control a color change of the segment (black to white or vice versa);

Low voltage deviations dV (−2V, +2V) can be used to maintain the segment color (black to black or white to white).

For an electrophoretic display, it is necessary to have a specific waveform (or sequence) method to avoid artifacts or "ghost" effects (due to interference between adjacent areas of the screen that have different colors). A main artifact can be avoided by switching all the segments and the background from white to black or vice versa.

In FIG. 7, a recommended "waveform" method from the Eink Company is used to avoid the above problems which is called "Global White Black Waveform". The values of the voltages applied to the common electrode 18, the segments and the background, appearing on the y-axis on the right-hand of the diagram, correspond to those of the preferred mode of the invention.

To avoid damaging the display, it is preferable to have a so-called "balanced" control mode. This means that the average voltage between the common electrode 18 and each of the segments must tend towards 0, over all the cycles of the display over its entire lifetime. However, an imbalance may occasionally exist for the display of a given color, but over a cycle consisting of switching from one color to another and then returning to the initial color, the average value of the voltage applied for the segment concerned must tend towards 0.

The preferred "global white-black waveform" method, implies a specific duty cycle ratio on the display cycle formed by T1+T2+T3 (FIG. 7). Four scenarios that may occur simultaneously on a display cycle should be considered:

1-Maintaining the Black Segment (Curve 1):

T1: 5/17 period, switching from Black to White;

T2: 7/17 period, switching from White to Black;

T3: 5/17 period, configuration not resulting in any color change.

2-Maintaining the Segment in White (Curve 2):

T1: 5/17 period, configuration not resulting in any color change.

T2: 7/17 period, switching from White to Black;

T3: 5/17 period, switching from Black to White. 3-Switching the segment from Black to White (curve 3):

T1: 5/17 period, switching from Black to White;

T2: 7/17 period, switching from White to Black;

T3: 5/17 period, switching from Black to White. 4-Switching the segment from White to Black (curve 4):

T1: 5/17 period, configuration not resulting in any color change;

T2: 7/17 period, switching from White to Black;

T3: 5/17 period, configuration not resulting in any color change.

This specific duty cycle enables the balanced control of the display, the calculation of which is described below.

Similarly, it is also possible to use the

"Global Black White Waveform" or "black and white global waveform" method which consists in inverting the 2 sequences T1 and T2.

A complete prototype was successfully produced using a ST development board (STM8 Discovery with MCU STM8L152C6, an experimental and discrete components board for the charge pump circuit, of a 3-digit EPD display from the "Eink" company.

A programme or microcode P has been developed to program the microcontroller 24 to display the 3 digits on the display screen.

Figure 8:
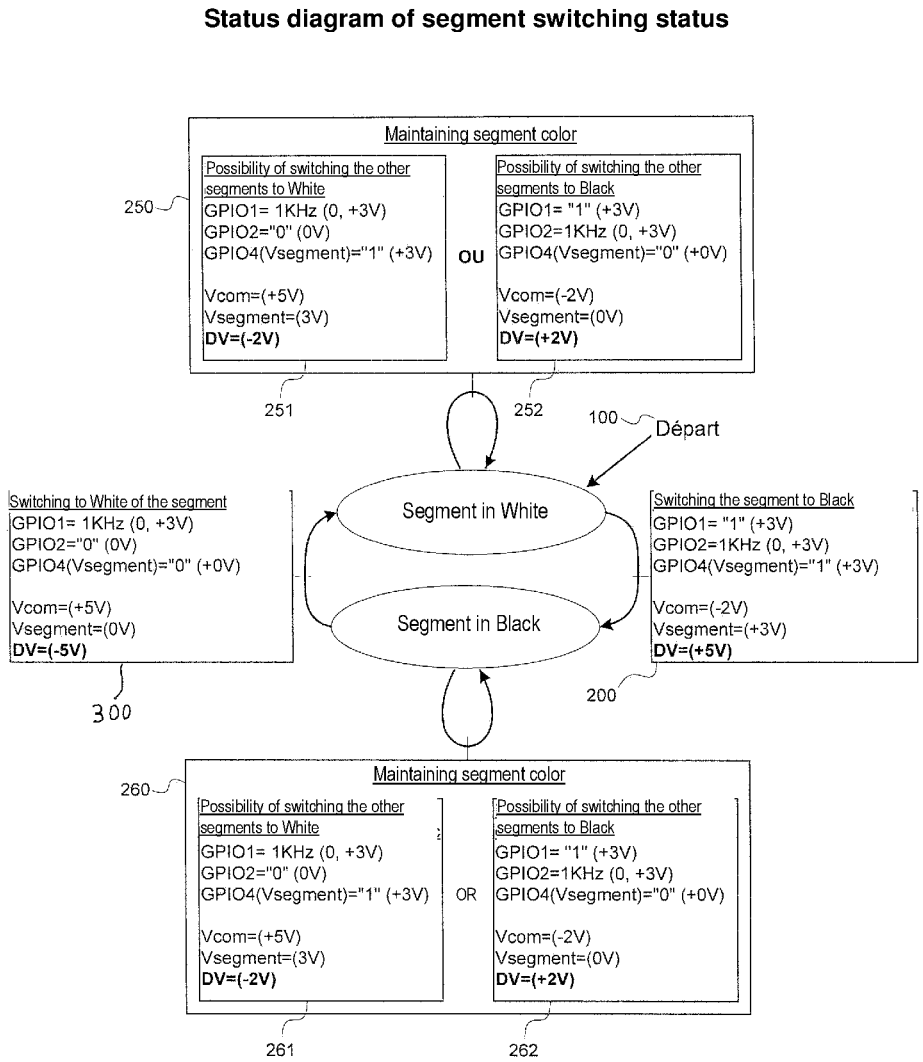
FIG. 8 illustrates the different elementary steps of the method (and/or programme P) for controlling the display device, the recommended (or preferred) transitions of which are as shown in FIG. 7.

In FIG. 8, an overview of this programme P is shown in relation thereto, hereunder, for switching a segment; it can be extrapolated to other segments and ports.

The microcontroller 24 receives information such as an OTP number to be displayed on the display (the OTP information includes or requires, for example, at least one switching of a segment b among the seven segments included in the display to form a digit). This segment b is connected to the port GPIO4 (FIG. 5)

The microcontroller can know the current bistable status of the segment b by consulting either directly a memory listing the last status of the black or white segment or indirectly by means of information external to the microcontroller.

During the step 100 of the method (or programme P) 100, the microcontroller deducts that the segment is in a "white" eUou status which corresponds to a set of instructions issued previously and which led to a voltage difference that caused a switching to white.

The programme can then switch the color of the segment to black 200 or maintain the color of the segment white and switch other segments of the display 250 to black 252 or white 251.

Once the segment has switched to black, the programme can switch the color of the segment back to white 300 or it can maintain the color of the segment in black and switch other segments of the display 260 to black 262 or white 261.

Once the segment has switched back to white, the programme can return to the initial sequence and restart a new sequence.

Otherwise, the microcontroller can provide for a "reset" or "zeroing" step (white or black) of all the segments regardless of their initial status. This procedure is particularly useful when the product is first initialized or the initial status of the segments is not necessarily known.

The programme P of the microcontroller is configured to control the ports, according to the sequence, as follows:

For switching the segment from white to black 200, the microcontroller programme P configures the port GPIO4 to a level "1" i.e. +3V, the port GPIO1 to a logical level "1" or +3V and generates a square clock signal of 1 kHz and having levels 0 and +3V on the port GPIO2, which generates a voltage Vcom of −2V at the output 27 of the charge pump 26 and a voltage Vsegment of +3V.

This results in a voltage difference dV of +5V sufficient to switch the visible colour of the capsules forming the segment 4 from a "white" to a "black" status.

For switching the segment 300 from black to white, the microcontroller programme P configures the port GPIO4 to a level "0" i.e. +0V, the port GPIO2 to a logical level "0" or +0V and generates a square clock signal of 1 kHz and having levels of 0 and +3 V on the port GPIO1, which generates a voltage Vcom of +5V at the output 27 of the charge pump 26 and a voltage Vsegment of +0V. This results in a voltage difference dV of −5V sufficient to switch the visible colour of the capsules forming the segment 4 from a "black" to a "white" status.

To maintain the color and the switching of the other segments 252, 262 from white to black, the microcontroller programme P sets the port GPIO4 to a level "0" or +0V, the port GPIO1 to a logical level "1" i. e. +3V and generates a square clock signal of 1 kHz and having levels of 0 and +3 V on the port GPIO2, which generates a voltage Vcom of −2V at the output 27 of the charge pump 26 and a voltage Vsegment of +0V. This results in a voltage difference dV of +2V which maintains the current color of the segment and allows the capsules forming the other segments to switch from a "white" color status to a "black" status if the corresponding GPIO is at a logical level "1" or +3V. To maintain the color and the switching of the other segments 251, 261 from black to white, the microcontroller programme P configures the port GPIO4 to a level "1" or +3V, the port GPIO2 at a logical level "0" i. e. +0V and generates a square clock signal of 1 kHz and having 0 and +3 V levels on the port GPIO1, which generates a voltage Vcom of +5V at the output 27 of the charge pump 26 and a voltage Vsegment of +3V. This results in a voltage difference dV of −2V which maintains the current color of the segment and allows the capsules forming the other segments to switch from a "black" color status to a "white" status if the corresponding GPIO is at a logical level "0" or +0V. Upon completion of the above control sequences, the different ports used to control the display GPIO1, GPIO2 & GPIO4 in a preferred mode can be set to "0" 0V or in a high impedance status (HIZ).

In each case, the microcontroller can preferably (or not) save the change of status of the segment(s) in memory for later consultation.

FIG. 6 shows an electrical diagram and operation of the charge pump:

The charge pump 26 is a voltage generator in accordance with the preferred embodiment of the invention; The electrical/electronic diagram includes two stages (or sub-parts 28, 29) having respectively a input GPIO1, GPIO2 and a common output Vcom:

The stage 28 (or doubling circuit), relating to the input GPIO1, includes a P-type field effect transistor Q1 mounted with diodes D1, D2 and capacities C1, C3;

The stage 29 (or inverter circuit), relating to the input GPIO2, includes a Q2 N-type field effect transistor, mounted with diodes D3, D4 and capacities C2, C4.

The charge pump is therefore preferably based here on the combination of an electrical voltage doubling circuit 28 and an electrical voltage inverter circuit 29 which can be alternately switched by means of two MOS FET transistors and the output voltage of which, from one or the other charge pump is combined on a single line.

For the display of an electrophoretic segment, no multiplexing is possible, meaning that each segment must be controlled individually by a GPIO port of the microcontroller.

Two other pins are required: one 20 for the background of the display (area 20 visible other than a segment, but considered as a segment for the control) and the other 18 for the common segments.

An electrophoretic display is a bistable display that means that only a change of status must be controlled. The basic operation is as follows:

when a voltage of +5V is applied between a segment and the common electrode, the segment switches to black;

and when a voltage of −5V is applied between a segment and the common electrode, the segment switches to white;

Otherwise, when no voltage is applied, the segment remains stable by maintaining its current (white or black) status or when the absolute value of the voltage is less than 2.5 volts.

In the embodiment, the segments 21, 22, 23 and the background 20 are directly connected to the input/output ports of the microcontroller with a voltage excursion from 0 to 3V.

A voltage Vcom, from the charge pump and having a voltage excursion of −2V or +5V with respect to ground, is applied to the transparent common electrode 18 of the segments. This is a viable design as these two voltage values cannot be applied directly to or generated by the input/output ports of the microcontroller (limitation of the output voltage excursion between 0 and 3V).

The components used in the example shown include a transistor 01: N-MOS FET CSD13381F4; one transistor 02: P-MOS FET CSD23381F4; Four capacities C1-C4: 100 nF 10V; Four diodes 01-04: RB521.

The operation of the charge pump is as follows: The output voltage of the charge pump Vcom=+5V when:

A 1 KHz clock with a duty cycle of 50% is generated on GPIO1;

GPIO2 is set to "0" (0V);

In this case, the transistor 02 is in the blocked status and the stage 29 including the capacitor C2 and the diodes 01, 02 has no impact on the output Vcom. On the other hand, the stage 28, which comprises the components 01, C1, C3, 01 and 02, forms a voltage doubler and VCom reaches 5V due to the voltage drop in the diodes 01 and 02 in the direct direction.

The output voltage of the charge pump Vcom=−2V when:

GPIO1 is set to "1" (+3V);

A 1 KHz clock with a duty cycle of 50% is generated on GPIO2.

In this case, the transistor 01 is in the blocked status and the stage 28 including the components C1, 01, 02 has no effect on the Vcom output; the stage 29 including the components 02, C2, C4, 03 and 04 constitutes a voltage inverter and the output voltage VCom reaches −2V due to the voltage drop_in the diodes 03 and 04 in the direct direction.

Alternatively, another possible embodiment of the generator can be a generator system comprising two independent charge pumps that can be activated or deactivated by the microcontroller and generating respectively +5V and −2V and one or the other of the voltages of which would be selected by an electronic switch. However, such a mode would be more complex and expensive mainly because of the switch (which is avoided in the preferred embodiment).

FIG. 7 illustrates recommended (or preferred) intermediate steps and/or transitions of color and/or images of the display device, in accordance with the preferred mode of the invention detailed below. For the switching of color or status of the display segment areas, the invention prefers to use a particular cycle of transition of the segments (and/or the background) states (drawing 43) for switching the display areas from black to white or vice versa.

The drawings 41, 42 and 43 (FIG. 7) illustrate the different segment status change curves for switching from the digit "1" to the digit "2". Each curve of the switching (or maintenance) of the segment color referenced b, f, c, e is numbered respectively from 1 to 4 as follows:

1 for maintaining the segment b from black to black 2 for maintaining the segment f from white to white 3 for switching the segment c from black to white;

4 for switching the segment e from white to black.

In the drawings 42 and 43, the intermediate transitions of the segments and/or the background color (or the status of the segments or the background) taking place to carry out the operation of changing the number from 1 to 2 are shown in pictures. A complete display cycle comprises the succession of 3 main steps:

a first step of whitening all the segments (including the background) that are black for a recommended time T1 equal to 5 time units (i.e. 500 ms, the unit being equal to 100 milliseconds);

followed by a second step of blackening all the segments (including the background) for a time T2 equal to 7 time units (i. e. 700 ms);

and completed by a third step of setting the segments displaying the digit "2" to the final black color for a time T3 equal to 5 time units (i. e. 500 ms).

The drawing 43 (FIG. 7) also illustrates the different voltages required for the segments and the common electrode (ITO) for each transition step shown in the drawing 42 (and in accordance with the preferred mode of the invention):

"Vcom" for the transparent common electrode 18;

"Vsegment" for the segment a to f concerned;

as well as the resulting voltage difference (dV) across the segment.

On the left, on the y-axis, are the electrical zones concerned, respectively, the transparent common electrode 18 (or ITO), the segment b which must remain black, the segment f and the background which must remain white, the segment c which must switch from black to white and the segments a, d, e & g which must switch from white to black.

On the right, on the y-axis, are indicated, the voltages of +5 volts, +3 volts, 0 volts, −2 volts and −5 volts applied to each of the above-mentioned electrical zones.

The invention may preferably provide, for the control of the display, the image or color steps and/or transitions indicated and respecting the times and voltages described in FIG. 7.

The above steps and/or transitions are implemented using a corresponding programme P, stored in the memory of the microcontroller 24 in FIG. 5 (or memory external to the microcontroller). This programme is executed by the microcontroller to directly command or control the inputs of the display 2 (via the corresponding output ports "GPIO3 to GPIO10" of the microcontroller) with a voltage signal equal to 0 or +3 volts.

The programme P also controls, via the output ports GPIO1 and GPIO2 of the microcontroller, the voltage Vcom of the transparent electrode 18, via the generator 26, to obtain a signal Vcom of +5 volts, −2 volts or 0 volt.

Thus, the invention makes it possible to increase the differential voltage Vsegment-Vcom applied to the background segments a to f eUou while using input/output ports with a voltage excursion from 0V to +3V. The compensation to obtain a sufficient control potential difference is carried out by injecting a voltage/potential of +5V or −2V on the common electrode Vcom 18.

This results in voltage differences dV on the ink capsules 5C of up to +5V or −5V to change the color and voltage differences dV of up to +2V or −2V to maintain the color.

Checking the balance of the control signal voltage in relation to FIG. 7.

The signal is said to be balanced if the average voltage value is zero for the sequence of the different phases over a complete cycle. A complete cycle includes a color change and a return to the original color.

1)Black to black: Integration of the signal voltage over the T1+T2+T3 period to switch from black to black: $(-5\times5)+(5\times7)+(-2\times5)=0$;

2) White to white: Integration of the signal voltage over the T1+T2+T3 period to switch from white to white: $(-2\times5)+(5\times7)+(-5\times5)=0$;

3)Black to white: Integration of the signal voltage over the T1+T2+T3 period to switch from black to white: $(-5\times5)+(5\times7)+(-5\times5)=-15$;

4) White to black: Integration of the signal voltage over the T1+T2+T3 period to switch from white to black: $(-2\times5)+(5\times7)+(-2\times5)=15$.

For a complete cycle, the invention alternates cycle 3) black to white, then cycle 4) to switch from white to black with the possible insertion of steps 1) and 2). Integration of the signal voltage of the respective T1+T2+T3 periods to switch from black to white and of the T1+T2+T3 periods to switch from white to black: $dT=-15+15=0$. Inserting steps 1) and/or 2) to maintain the black or white color does not change the signal balance, because the signal integration on T1+T2+T3 for these 2 steps is zero.

Thus, the signal balance (which consists in having an average value of zero voltage over a complete cycle) is achieved by this control and transition scheme in FIG. 7 according to the preferred mode.

The status diagram in FIG. 8 illustrates an example of the display method (or programme) in accordance with an elementary mode of the invention for switching the segment from one color to another.

In step 100, the programme P starts for the first time and has therefore not yet completed any segment control sequence. Here the initial status of the segments is assumed to be white.

As history is not known, the programme can command a prior "zeroing" (or erasing) of the display by switching all the segments and/or the background before a display command, to a status of all white or all black color. This can happen, for example, when the unit is switched on for the first time or after a battery change.

At any time, the programme can switch a segment from white to black 200 or from black to white 300.

If the display contains several segments, additional steps to maintain the color of the segment 250, 260 can be performed, so as to have different colors between the segments. 2 sequences are then possible:

Maintaining the color of the segment and switching the other segments from black to white (251 & 261)

Maintaining the color of the segment and switching the other segments from white to black (252 & 262) Depending on the sequences, the programme P configures the GPIOs as described above.

At any time (200, 250, 260 & 300), the programme can be suspended after executing a control sequence and preferably storing the current status of the segments. A history of the segment status can be stored in the microcontroller memory or external memory for later reference or recalculated according to parameters internal or external to the microcontroller. The programme will then be able to resume the next appropriate cycle thanks to the knowledge of the current status of the segments that has been stored.

After a control sequence has been executed, the display then retains the colors of each of the segments, with the latter being bistable.

These steps of controlling the display device may be in accordance with steps of the programme P, in particular for the succession of sequences and the respective duration of the recommended sequences according to the preferred mode of the invention to avoid the artifacts described above. The preferred control mode may include the string of the 3 successive sequences (steps or transitions):

1—Homogenization in a uniform color of all the segments including the black or white background with a duration of 5 time units.

2—Inversion of the uniform color of all the segments including the white background if previously black or black if previously white with a duration of 7 time units.

3—If so needed, updating the segments in white if previously black or black if previously white with a duration of 5 time units.

The invention also has the advantage of allowing flexibility in the supply with components by avoiding dependence on a specific microcontroller integrating an electrophoretic display control (the electrophoretic or EPD controls integrated in the microcontroller being uncommon). It reduces costs as standard microcontrollers with additional external components can be more competitive than microcontrollers with integrated electrophoretic control.

This control system has the advantage of using standard components, the thickness of which is compatible with a form factor such as a smart card.

The invention can be applied to any other electrical apparatus using segmented displays (such as digital, alphanumeric displays or indicator lights) and having a display control microcontroller designed to provide, on output ports, a maximum voltage lower in absolute value than the operating voltage of the display.

In particular, any device with a segmented bistable electrophoretic display, supplied in particular with a voltage lower than +5 volts, could implement the invention.

What is claimed is:

1. A method for producing a segmented electrophoretic display device comprising a bistable display operating at predetermined opposing voltages and an electronic circuit with a microcontroller for controlling the display according to a control program, comprising the following steps:

supplying said microcontroller, which is (i) different from a specific display controller for a bistable display, and (ii) configured to deliver voltages on input/output ports, lower in absolute value than the predetermined voltages, compensating the voltages delivered by the microcontroller with at least one compensation voltage to at least reach said predetermined opposing voltages, and supplementing the output voltages by additional voltages or potentials generated in particular by means of a circuit of discrete components comprising capacities, diodes and transistors.

2. The method according to claim 1, wherein said compensation is performed using a voltage generator.

3. The method according to claim 2, wherein said control programme controls said voltage generator to provide said compensation voltage.

4. The method according to claim 3, wherein said voltage generator is configured to provide voltage values equal to (+5; −2) volts on a single output.

5. The method according to claim 4, wherein said microcontroller is configured to provide a pair of voltages equal to or within 10 percent of (+3; 0) volts on input/output ports.

6. The method according to claim 3, wherein said control program controls said voltage generator to provide voltage values equal to (−5V, +5V) to control a color switching of the segments or the background of the display and voltage values equal to (−2V, +2V) to maintain the colors of the segments or the background.

7. The method according to claim 1, wherein said microcontroller comprises GPIO input/output ports that can be individually controlled with a "0", "1" status and high impedance.

8. The method according to claim 1, wherein said program provides for a string of the following successive sequences:

homogenization in a uniform color of all the segments including a black or white background with a duration of 5 time units;

inversion of the uniform color of all the segments including the white background if previously black or black if previously white with a duration of 7 time units;

if needed, updating the segments in white if previously black or black if previously white with a duration of 5 time units.

9. A segmented electrophoretic display device comprising a bistable display operating at predetermined opposing voltages and an electronic circuit with a microcontroller for controlling the display according to a control program, comprising:

said microcontroller, which is (i) different from a specific display controller for a bistable display, and (ii) configured to deliver voltages on input/output ports, lower in absolute value than the predetermined voltages, a compensation voltage generator configured to compensate said voltages delivered by the microcontroller and to reach at least said predetermined opposing voltages, and a circuit of discrete components comprising capacities, diodes and transistors, said circuit of discrete components generating additional voltages or potentials supplementing the output voltages.

10. The m device according to claim 9, characterized wherein the voltage generator comprises a hybrid charge pump combining a voltage doubling circuit and a voltage inverter circuit, the respective output voltages of the doubling circuit and the inverter circuit being alternately combined on a single output of the charge pump.

11. The m device according to claim 9, wherein the microcontroller comprises a control program for supplying the voltages at times and for durations according to a balanced control scheme so that the average value of the voltage seen from each of the segments is within 10% of 0 volt.

* * * * *